US008801147B2

(12) United States Patent
Kusunoki et al.

(10) Patent No.: US 8,801,147 B2
(45) Date of Patent: Aug. 12, 2014

(54) INKJET HEAD AND INKJET RECORDING APPARATUS

(75) Inventors: Ryutaro Kusunoki, Mishima (JP); Chiaki Tanuma, Tokyo (JP); Shuhei Yokoyama, Mishima (JP); Ryuichi Arai, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/600,456

(22) Filed: Aug. 31, 2012

(65) Prior Publication Data

US 2013/0070030 A1 Mar. 21, 2013

(30) Foreign Application Priority Data

Sep. 15, 2011 (JP) ..... 2011-202169
Sep. 15, 2011 (JP) ..... 2011-202170
Jul. 31, 2012 (JP) ..... 2012-170043

(51) Int. Cl.
*B41J 2/14* (2006.01)

(52) U.S. Cl.
USPC ..... 347/47; 347/68; 347/70; 347/72

(58) Field of Classification Search
USPC ..... 347/47, 68–72
See application file for complete search history.

(56) References Cited

U.S. PATENT DOCUMENTS

2011/0037813 A1* 2/2011 Nakatani ..... 347/70
2012/0056947 A1 3/2012 Tanuma et al.
2013/0222481 A1 8/2013 Yokoyama et al.

FOREIGN PATENT DOCUMENTS

JP 10-058672 3/1998
JP 2002-264338 9/2002
JP 2007-044967 2/2007
JP 2010-110969 5/2010
JP 2011-056939 3/2011

OTHER PUBLICATIONS

First Office Action of Reason for Rejection for Japanese Patent Application No. 2012-170043 Dated Feb. 4, 2014, 4 pgs.

* cited by examiner

*Primary Examiner* — Henok Legesse
(74) *Attorney, Agent, or Firm* — Amin, Turocy & Watson, LLP

(57) ABSTRACT

According to one embodiment, an inkjet head includes a substrate, a nozzle plate, and an actuator incorporated in the nozzle plate. The nozzle plate includes a nozzle provided to communicate with an ink pressure chamber, and a vibrating plate exposed to the ink pressure chamber. The actuator displaces the vibrating plate in the thickness direction to pressurize ink in the ink pressure chamber via the vibrating plate and eject the ink from the nozzle. The ink pressure chamber has a first dimension in the thickness direction of the substrate and a second dimension in a direction orthogonal to the thickness direction of the substrate. The first dimension is larger than the second dimension.

6 Claims, 5 Drawing Sheets

INKJET HEAD AND INKJET RECORDING APPARATUS

CROSS-REFERENCE TO RELATED APPLICATIONS

This application is based upon and claims the benefit of priority from Japanese Patent Applications No. 2011-202169, filed on Sep. 15, 2011, No. 2011-202170, filed on Sep. 15, 2011 and No. 2012-170043, filed on Jul. 31, 2012, the entire contents of all of which are incorporated herein by reference.

FIELD

Embodiments described herein relate generally to an inkjet head and an inkjet recording apparatus including the inkjet head.

BACKGROUND

For example, an inkjet head of an on-demand type ejects ink droplets to recording paper to form an image on the recording paper.

An inkjet head of this type includes plural nozzles and plural actuators corresponding to the respective nozzles. The actuators include piezoelectric elements and common electrodes and individual electrodes that apply a voltage to the piezoelectric elements. The common electrodes and the individual electrodes are electrically connected to a driving circuit respectively via conductor patterns. Further, the nozzles and the actuators are located on opposite sides each other across an ink pressure chamber.

When a driving voltage is applied to the piezoelectric elements from the driving circuit via the common electrodes and the individual electrodes, the piezoelectric elements are deformed. Consequently, ink supplied to the ink pressure chamber is pressurized. A part of the pressurized ink is ejected from the nozzles as ink droplets.

In the inkjet head in the past, the nozzles and the actuators are separate components independent from each other. Therefore, when the inkjet head is manufactured, an exclusive process for accurately bonding a member in which the nozzles are formed and a member in which the actuators are formed is necessary. As a result, production efficiency is deteriorated.

In order to solve this problem, an inkjet head in which the nozzles and the actuators are integrated is devised. However, if the nozzles and the actuators are integrated, when the actuators pressurize the ink in the ink pressure chamber, the pressurized ink escapes to the outside of the ink pressure chamber. The ink may not be able to be efficiently ejected from the nozzles. Therefore, it may be difficult to obtain a high-quality image.

DETAILED DESCRIPTION

In general, according to one embodiment, an inkjet head includes a substrate in which an ink pressure chamber is formed, a nozzle plate laminated on the substrate, and an actuator incorporated in the nozzle plate. The nozzle plate includes a nozzle provided to communicate with the ink pressure chamber, and a vibrating plate exposed to the ink pressure chamber. The actuator displaces the vibrating plate in the thickness direction to pressurize ink in the ink pressure chamber via the vibrating plate and eject the ink from the nozzle. The ink pressure chamber has a first dimension in the thickness direction of the substrate and a second dimension in a direction orthogonal to the thickness direction of the substrate. The first dimension is larger than the second dimension.

An embodiment is explained with reference to FIGS. 1 to 6.

Figure 1:
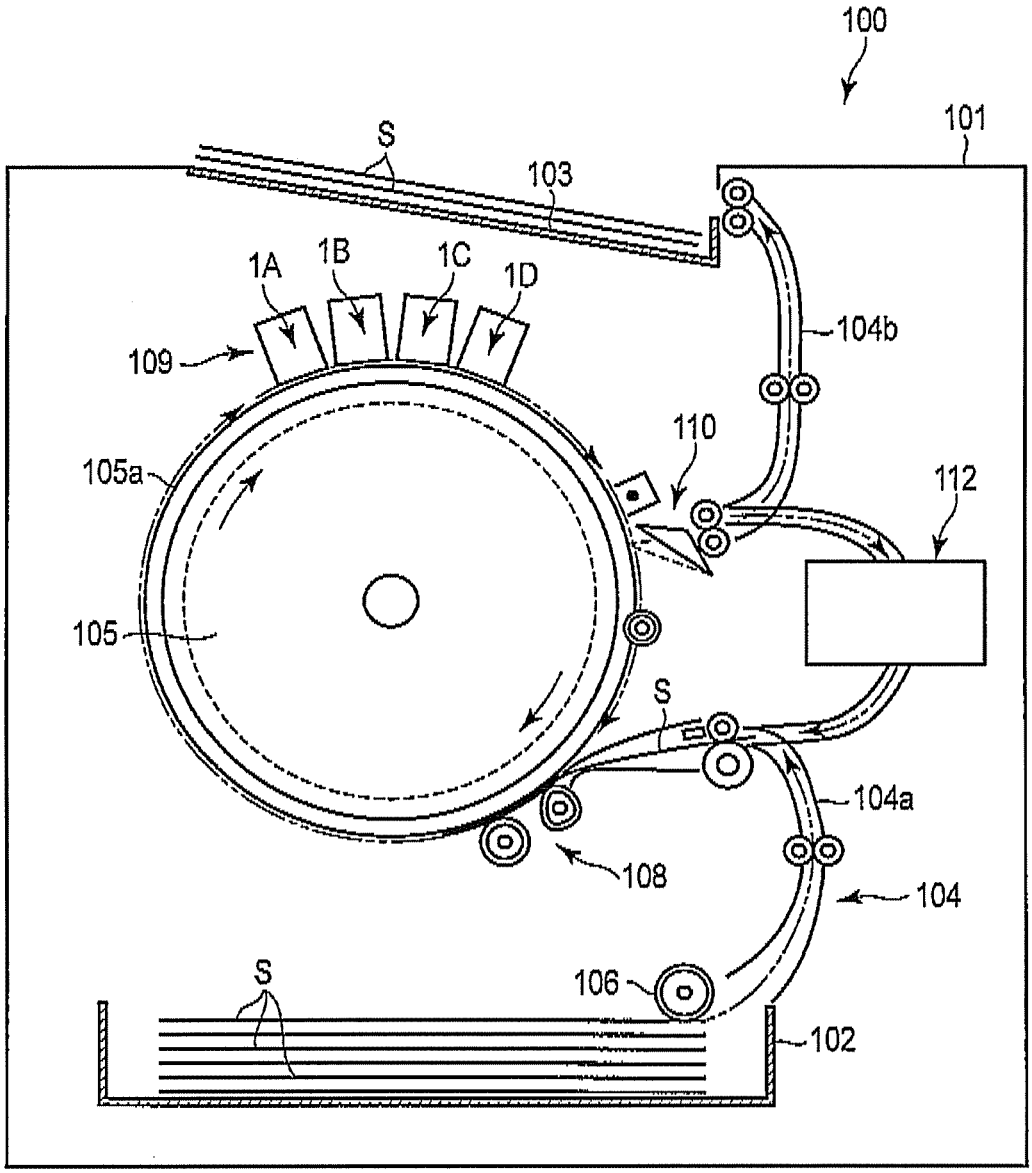
FIG. 1 is an exemplary schematic side view of an inkjet recording apparatus according to an embodiment.

FIG. 1 is a schematic diagram of an example of an inkjet recording apparatus 100. The inkjet recording apparatus 100 includes a box-like housing 101 that forms the outer hull of the inkjet recording apparatus 100. As shown in FIG. 1, a paper feeding cassette 102, a paper discharge tray 103, a conveying path 104, and a holding drum 105 are housed on the inside of the housing 101.

The paper feeding cassette 102 is a component that stores sheets S, which are an example of recording media. The paper feeding cassette 102 is arranged in the bottom of the housing 101. As the sheets S, for example, plain sheets, art paper, OHP sheets, and the like can be used. The paper discharge tray 103 is provided in an upper part of the housing 101 and exposed to the outside of the housing 101.

The conveying path 104 includes an upstream section 104*a* continuous to the paper feeding cassette 102 and a downstream section 104*b* continuous to the paper discharge tray 103. The sheets S stored in the paper feeding cassette 102 are delivered to the upstream section 104*a* of the conveying path 104 by a roller 106 one by one.

The holding drum 105 is arranged between the paper feeding cassette 102 and the paper discharge tray 103. The sheet S delivered from the paper feeding cassette 102 to the upstream section 104*a* of the conveying path 104 is led to the downstream section 104*b* of the conveying path 104 through an outer circumferential surface 105*a* of the holding drum 105. Specifically, the holding drum 105 is configured to rotate at constant speed in the circumferential direction in a state in which the holding drum 105 holds the sheet S on the circumferential surface 105*a*.

As shown in FIG. 1, a sheet pressing device 108, an image forming device 109, a charge removing device 110, and a cleaning device 111 are arranged around the holding drum 105. The sheet pressing device 108, the image forming device 109, the charge removing device 110, and the cleaning device 111 are arranged in order from upstream to downstream along the rotating direction of the holding drum 105.

The sheet pressing device 108 presses the sheet S, which is supplied from the upstream section 104*a* of the conveying path 104 to the outer circumferential surface 105*a* of the holding drum 105, against the outer circumferential surface 105*a* of the holding drum 105. The sheet S pressed against the outer circumferential surface 105*a* of the holding drum 105 is attracted to the outer circumferential surface 105*a* of the holding drum 105 by an electrostatic force.

The image forming device 109 is a component for forming an image on the sheet S attracted to the outer circumferential surface 105*a* of the holding drum 105. The image forming device 109 in this embodiment includes, for example, a first inkjet head 1A that forms a cyan image, a second inkjet head 1B that forms a magenta image, a third inkjet head 1C that forms a yellow image, and a fourth inkjet head 1D that forms a black image. The first to fourth inkjet heads 1A, 1B, 1C, and 1D are arrayed spaced apart from one another in the rotating direction of the holding drum 105. The rotating direction of the holding drum 105 can be rephrased as a conveying direction of the sheet S conveyed along the outer circumferential surface 105*a* of the holding drum 105.

The charge removing device 110 has a function of removing charges of the sheet S on which a desired image is formed and peeling the sheet S off the outer circumferential surface 105*a* of the holding drum 105 after the charge removal. The sheet S peeled off the outer circumferential surface 105*a* of the holding drum 105 is led to the paper discharge tray 103 through the downstream section 104*b* of the conveying path 104.

The cleaning device 111 has a function of cleaning the outer circumferential surface 105*a* of the holding drum 105 from which the sheet S is peeled. Further on a downstream side in the rotating direction of the holding drum 105 than the charge removing device 110, the cleaning device 111 is movable between a position where the cleaning device 111 is in contact with the outer circumferential surface 105*a* of the holding drum 105 and a position where the cleaning device 111 is separated from the outer circumferential surface 105*a* of the holding drum 105.

Further, the inkjet recording apparatus 100 according to this embodiment includes a reversing device 112 that reverses the front and the back of the sheet S. The reversing device 112 reverses the sheet S, which is peeled off the outer circumferential surface 105*a* of the holding drum 105 by the charge removing device 110, and returns the sheet S to the upstream section 104*a* of the conveying path 104. Consequently, the sheet S is supplied to the outer circumferential surface 105*a* of the holding drum 105 again in a state in which the front and the back of the sheet S are reversed. Therefore, it is possible to form desired images on both the front and rear surfaces of the sheet S.

The first to fourth inkjet heads 1A, 1B, 1C, and 1D included in the image forming device 109 basically include a common configuration. Therefore, in this embodiment, the configuration of the first inkjet head 1A is representatively explained.

Figure 2:
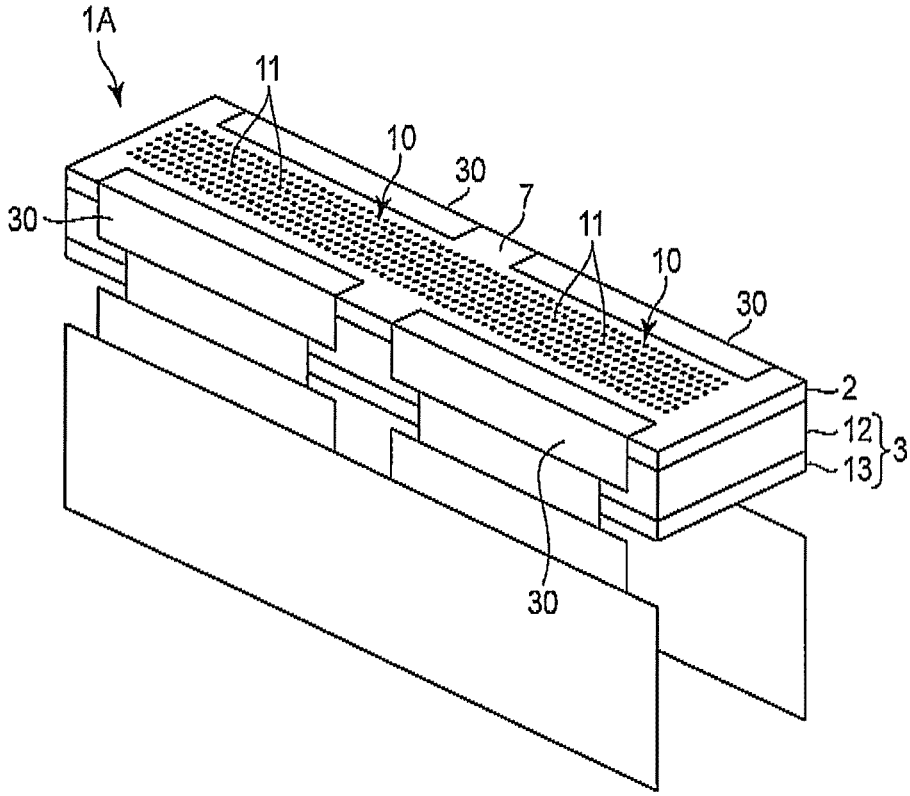
FIG. 2 is an exemplary perspective view of an inkjet head according to the embodiment.
Figure 4:
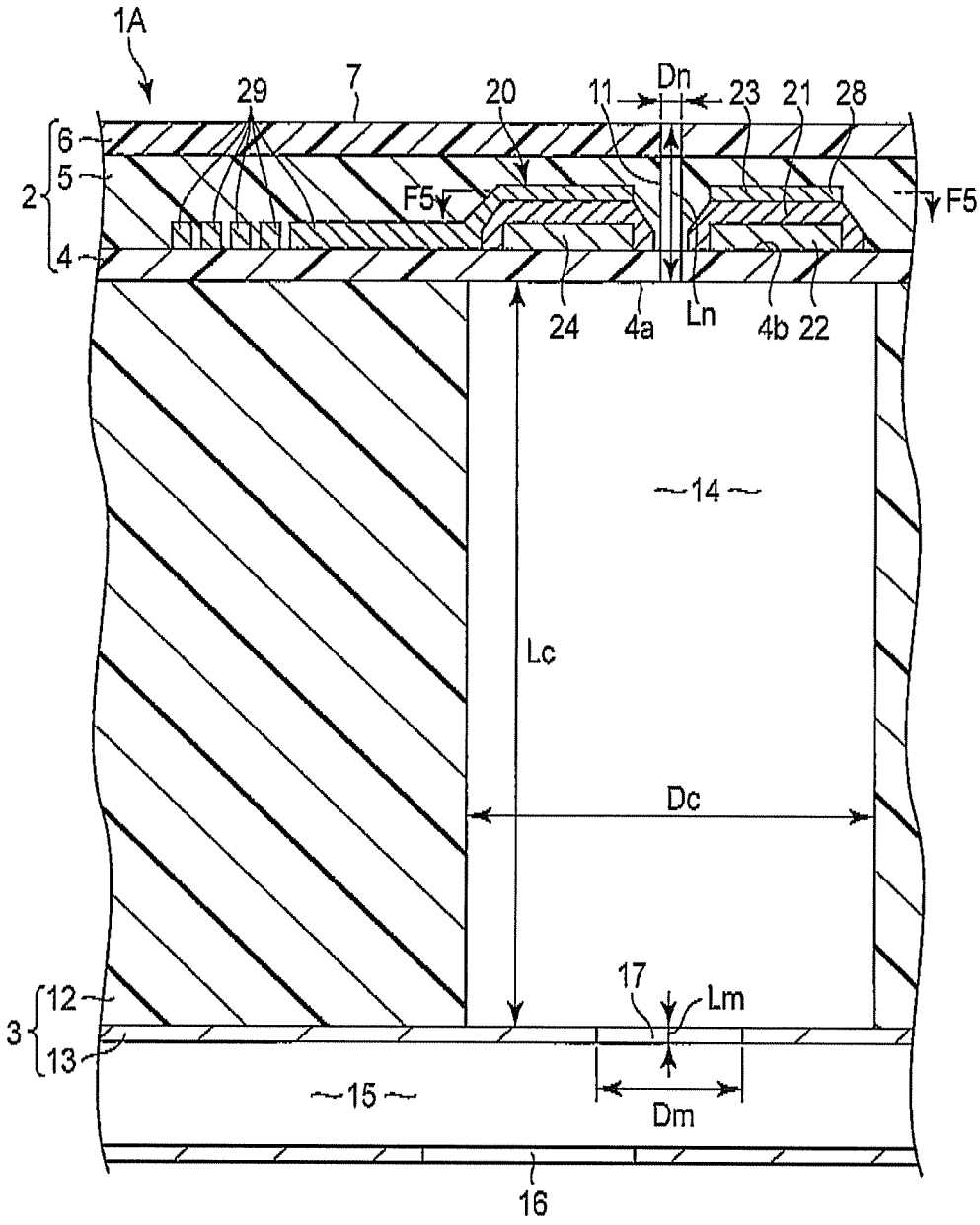
FIG. 4 is an exemplary sectional view taken along line F4-F4 shown in FIG. 3.
Figure 5:
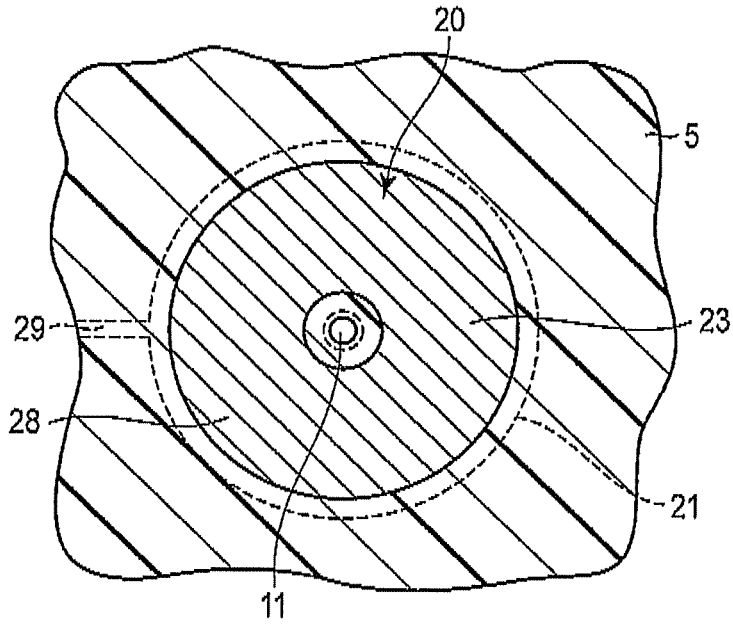
FIG. 5 is an exemplary sectional view taken along line F5-F5 shown in FIG. 4.

As shown in FIG. 2, the first inkjet head 1A has an elongated shape extending in the direction orthogonal to the conveying direction of the sheet S. The first inkjet head 1A includes a nozzle plate 2 and a head main body 3. As shown in FIG. 4, the nozzle plate 2 has a three-layer structure including a vibrating plate 4, a protective layer 5, and a liquid repellent film 6.

The vibrating plate 4 is formed of, for example, a silicon oxide film having electric insulation properties. The thickness of the vibrating plate 4 is about equal to or smaller than 6 μm. In this embodiment, the silicon oxide film is formed by thermal oxidation with substrate temperature set to about 1000° C. As a manufacturing method for the silicon oxide film, a CVD (chemical vapor deposition) or an RF magnetron sputtering method can be used.

The protective layer 5 is laminated on the vibrating plate 4. The protective layer 5 is formed of a resin material such as polyimide. The thickness of the protective layer 5 is about 4 μm. In this embodiment, the protective layer 5 is formed by, for example, spin coating. As the material of the protective layer 5, for example, a resin material such as polyurea or an oxide film of $SiO_2$ or the like can also be used. In this case, the thickness of the protective layer 5 is about 3 μm to 20 μm.

The liquid repellent film 6 is laminated on the protective layer 5. The liquid repellent film 6 is formed of, for example, a material having a characteristic for repelling ink such as fluorocarbon resin. In this embodiment, the liquid repellent film 6 is formed by, for example, the spin coating. The thickness of the liquid repellent film 6 is about 0.1 μm to 5 μm and preferably 1 μm. The liquid repellent film 6 forms a nozzle surface 7, which is the surface of the nozzle plate 2. The nozzle surface 7 is exposed to the outside of the first inkjet head 1A to face a surface to be printed of the sheet S.

Figure 3:
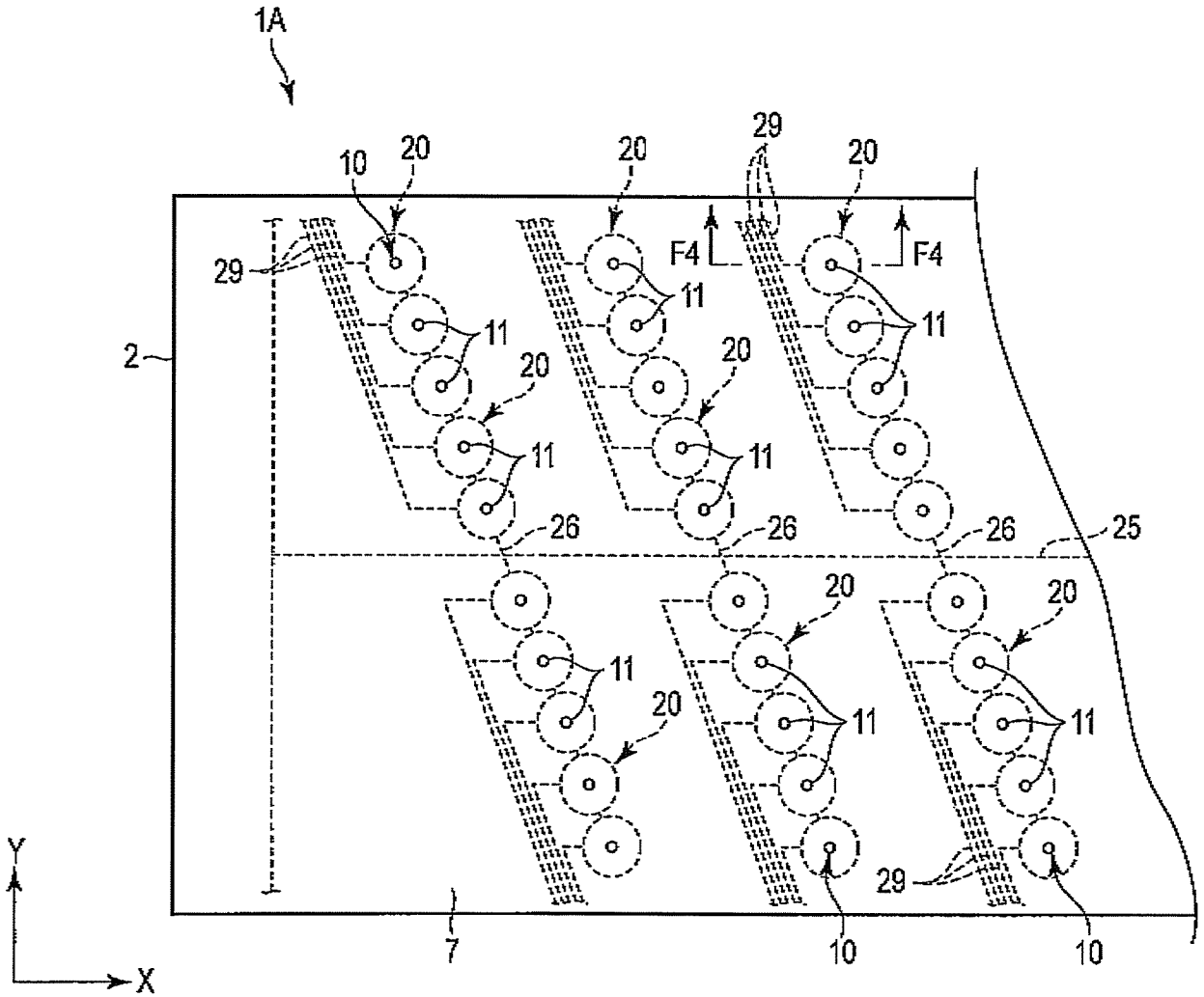
FIG. 3 is an exemplary plan view of the inkjet head in a state in which plural nozzle rows are arrayed on a nozzle surface of a nozzle plate.

As shown in FIGS. 2 and 3, plural nozzle rows 10 are formed on the nozzle plate 2. The nozzle rows 10 are arranged in a row spaced apart from one another in the longitudinal direction of the first inkjet head 1A indicated by an arrow X. The longitudinal direction of the first inkjet head 1A means the direction orthogonal to the conveying direction of the sheet S indicated by the arrow Y. The longitudinal direction of the first inkjet head 1A coincides with the width direction of the sheet S.

Each of the nozzle rows 10 includes plural nozzles 11. The nozzles 11 pierce through the nozzle plate 2 in the thickness direction. The nozzles 11 are linearly regularly arrayed spaced apart from one another. The nozzles 11 have, for example, a diameter of 20 μm and total length of 6 μm. The nozzles 11 are opened on the nozzle surface 7 of the nozzle plate 2 and a front surface 4*a* of the vibrating plate 4 located on the opposite side of the nozzle surface 7.

Further, in order to obtain desired resolution, the nozzles 11 opened on the nozzle surface 7 are arranged at a fixed pitch in the longitudinal direction of the nozzle plate 2.

The head main body 3 includes a first substrate 12 and a second substrate 13. The first substrate 12 is formed of, for example, a single silicon substrate. The thickness of the first substrate 12 is, for example, 400 μm. The first substrate 12 is laminated on the front surface 4*a* of the vibrating plate 4 and integrated with the vibrating plate 4.

Ink pressure chambers 14 are formed in the first substrate 12 in the same number as the nozzles 11. The ink pressure chambers 14 are formed in, for example, a cylindrical shape having a diameter of 190 μm. The ink pressure chambers 14 pierce through the first substrate 12 in the thickness direction. One opening ends of the ink pressure chambers 14 are closed by the vibrating plate 4.

In other words, the vibrating plate 4 is exposed to the ink pressure chambers 14. The ink pressure chambers 14 are provided to correspond to the nozzles 11. The nozzles 11 are respectively opened in the centers of the ink pressure chambers 14.

The second substrate 13 is made of a metal material such as stainless steel. The thickness of the second substrate 13 is, for example, 4 mm. The second substrate 13 is laminated on the first substrate 12 and fixed to the first substrate 12 using, for example, an epoxy adhesive.

Plural ink channels 15 are formed on the inside of the second substrate 13. The ink channels 15 are formed in, for example, a long groove shape that is 2 mm deep in the thickness direction of the second substrate 13. The ink channels 15 are located on the opposite side of the nozzles 11 with respect to the ink pressure chambers 14. Ink for image formation is distributed from the outside of the first inkjet head 1A to the ink channels 15 through ink supply ports 16.

The ink channels 15 communicate with the plural ink pressure chambers 14 through throttle holes 17. The throttle holes 17 are formed in the second substrate 13 to be coaxial with the nozzles 11. The throttle holes 17 have, for example, a diameter of 100 μm and total, length of 50 μm. The ink distributed from the ink supply ports 16 to the ink channels 15 is supplied to the ink pressure chambers 14 through the throttle holes 17.

In this embodiment, the ink pressure chambers 14 and the ink channels 15 communicate with each other via the throttle holes 17. However, the throttle holes 17 do not have to be provided. Specifically, for example, the ink channels 15 may be opened over the entire upper surface of the second substrate 13 to cause the ink channels 15 to directly communicate with the bottoms of the ink pressure chambers 14.

The second substrate 13 is not limited to stainless steel and may be formed of other metal materials such as an aluminum alloy and titanium. In addition, a material forming the second substrate 13 is not limited to metal. For example, taking into account a difference between the expansion coefficients of the nozzle plate 2 and the first substrate 12, it is possible to use other materials as long as the materials do not affect ink ejection pressure.

Specifically, nitrides and oxides such as alumina, zirconium, silicon carbide, silicon nitride, and barium titanate serving as ceramic materials can be used. Further, plastic materials such as ABS (acrylonitrile-butadiene-styrene), polyacetal, polyamide, polycarbonate, and polyethersulfone can be used.

As shown in FIGS. 3 and 4, the nozzle plate 2 incorporates plural actuators 20 that pressurize the ink. The actuators 20 are provided for the respective nozzles 11.

The actuators 20 are formed in a ring shape on the vibrating plate 4 to coaxially surround the nozzles 11 and are covered with the protective layer 5. Each of the actuators 20 includes a piezoelectric layer 21, a first electrode 22, and a second electrode 23.

The piezoelectric layer 21 is formed of, for example, PZT (lead zirconate titanate). As the material of the piezoelectric layer 21, PTO ($PbTiO_3$: lead titanate), PMNT($Pb(Mg_{1/3}Nb_{2/3})O_3$—$PbTiO_3$), PZNT($Pb(Zn_{1/3}Nb_{2/3})O_3$—$PbTiO_3$), ZnO, AlN, and the like can also be used.

The piezoelectric layer 21 is formed at substrate temperature of 350° C. by, for example, the RF magnetron sputtering method. The piezoelectric layer 21 has thickness of 2 μm and a diameter of 133 μm. In this embodiment, after the piezoelectric layer 21 is formed, heat treatment is applied to the piezoelectric layer 21 at 500° C. for three hours in order to impart piezoelectricity to the piezoelectric layer 21. Consequently, the piezoelectric layer 21 can obtain satisfactory piezoelectric performance. When the piezoelectric layer 21 is formed, polarization along the thickness direction of the piezoelectric layer 21 occurs.

As other manufacturing methods for the piezoelectric layer 21, a CVD (chemical vapor deposition), a sol-gel method, an AD method (aerosol deposition method), a hydrothermal method, and the like can be used. In this case, the thickness of the piezoelectric layer 21 is in a range of about 0.1 μm to 10 μm.

The first electrode 22 and the second electrode 23 are components for transmitting a signal for driving the piezoelectric layer 21. The first electrode 22 and the second electrode 23 are formed of a thin film of, for example, Pt (platinum) and Ti (titanium). The thin film is formed by, for example, a sputtering method. The thickness of the thin film is 0.5 μm.

As other materials forming the first electrode 22 and the second electrode 23, Ni (nickel), Cu (copper), Al (aluminum), Ti (titanium), W (tungsten), Mo (molybdenum), and Au (gold) can be used. The above-mentioned various kinds of metal can be laminated.

As a method of forming the first electrode 22 and the second electrode 23, for example, vapor deposition and plating can also be used. In this case, desired thickness of the first electrode 22 and the second electrode 23 is 0.01 μm to 1 μm.

As shown in FIG. 4, the first electrodes 22 are formed on the rear surface 4*b* of the vibrating plate 4. Each of the first electrodes 22 includes an electrode portion 24. The electrode portion 24 has a ring shape smaller in diameter than the piezoelectric layer 21. The electrode portion 24 is coaxially covered with the piezoelectric layer 21 and electrically connected to the piezoelectric layer 21. Further, the nozzle 11 coaxially pierces through the center of the electrode portion 24 and the center of the piezoelectric layer 21.

As shown in FIG. 3, the first electrodes 22 of the actuators 20 are electrically connected via plural relay wires 26 divided from a trunk wire 25. Therefore, the first electrodes 22 are connected to all the piezoelectric layers 21 in common. The first electrodes 22 act as common electrodes that apply a constant voltage to all the piezoelectric layers 21. According to this embodiment, the trunk wire 25 and the relay wires 26 are formed on the rear surface 4*b* of the vibrating plate 4 and covered with the protective layer 5. The wiring width of the trunk wire 25 is about 100 μm.

As shown in FIG. 4, each of the second electrodes 23 includes an electrode portion 28 and a wiring portion 29. The electrode portion 28 has a ring shape smaller in diameter than the piezoelectric layer 21. The electrode portion 28 is coaxially laminated on the piezoelectric layer 21 and electrically connected to the piezoelectric layer 21. Therefore, the piezoelectric layer 21 is held between the electrode portion 24 of the first electrode 22 and the electrode portion 28 of the second electrode 23. The nozzle 11 pierces through the center of the electrode portion 28.

The wiring portions 29 of the second electrode 23 are led from the outer circumferential edges of the electrode portions 28 to the outside of the actuators 20 along the rear surface 4*b* of the vibrating plate 4 while being spaced apart from one another.

Therefore, the second electrode 23 is individually connected to the piezoelectric layer 21 and acts as an individual electrode that causes each of the piezoelectric layers 21 to independently operate. According to this embodiment, the wiring portions 29 of the second electrodes 23 are covered with the protective layer 5 together with the electrode portions 28. The wiring portions 29 are wired through the circumference of the actuators 20. Therefore, the wiring width of the wiring portions 29 is about 15

The trunk wire 25 electrically connected to the first electrodes 22 and the wiring portions 29 of the second electrodes 23 are led to the outside of the first inkjet head 1A and electrically connected to plural tape carrier packages 30. The tape carrier package 30 is mounted with a driving circuit for driving the first inkjet head 1A.

The driving circuit supplies a driving voltage to the first electrode 22 and the second electrode 23 of each of the actuators 20. When an electric field in the same direction as the direction of the polarization of the piezoelectric layer 21 is applied from the first electrode 22 and the second electrodes 23 to the piezoelectric layer 21, the actuator 20 is about to repeat expansion and contraction in a direction orthogonal to the direction of the electric field. The direction orthogonal to the electric field means a direction along the front surface 4*a* of the vibrating plate 4.

Since the actuator 20 is formed on the vibrating plate 4, the vibrating plate 4 acts to prevent the expansion and contraction of the actuator 20. Therefore, stress is generated in a contact portion of the actuator 20 and the vibrating plate 4. The generated stress deforms the vibrating plate 4 to bend in the thickness direction.

As a result, the actuator 20 repeats the expansion and contraction in the direction orthogonal to the direction of the electric field, whereby the vibrating plate 4 exposed to the ink pressure chamber 14 vibrates in the thickness direction to increase the pressure of the ink in the ink pressure chamber 14. Therefore, a part of the ink pressurized in the ink pressure chamber 14 is ejected from the nozzles 11 to the sheet S as ink droplets.

In this embodiment, the ink pressure chamber 14 filled with the ink has a first dimension Lc in the thickness direction of the first substrate 12 and a second dimension Dc in the direction orthogonal to the thickness direction of the first substrate 12. The first dimension Lc can be rephrased as the length (the depth) of the ink pressure chamber 14. In this embodiment, the first dimension Lc is 400 μm, which coincides with the thickness of the first substrate 12. Similarly, the second dimension Dc can be rephrased as the diameter of the ink pressure chamber 14. In this embodiment, the second dimension Dc is 190 μm.

Therefore, the first dimension Lc of the ink pressure chamber 14 is set especially larger than the second dimension Dc. Consequently, the length (the depth) of the ink pressure chamber 14 is substantially larger than the diameter of the ink pressure chamber 14.

If the vibrating plate 4 bends in a direction for reducing the volume of the ink pressure chamber 14 and pressurizes the ink, the ink filled in the ink pressure chamber 14 receives pressure applied to the ink channel 15 on the opposite side of the nozzle 11. Therefore, the ink is about to escape to the ink channel 15 from the throttle hole 17. Therefore, it is likely that the ink cannot be efficiently ejected from the nozzle 11.

In the first inkjet head 1A according to this embodiment, the first dimension Lc of the ink pressure chamber 14 is set twice or more as large as the second dimension Dc. Therefore, it is possible to sufficiently secure a distance from one end of the ink pressure chamber 14, where the nozzle 11 is opened, to the other end of the ink pressure chamber 14 connected to the ink channel 15. If the first dimension Lc of the ink pressure chamber 14 is sufficiently large with respect to the second dimension Dc, the throttle hole 17 is unnecessary.

Therefore, even if the vibrating plate 4 bends in the direction for reducing the volume of the ink pressure chamber 14, it is possible to efficiently eject the ink in the ink pressure chamber 14 to the sheet S from the nozzle 11 before the ink in the ink pressure chamber 14 escapes to the ink channel 15. Therefore, the pressure of the ink ejected from the nozzle 11 and an amount of the ink are set appropriate. It is possible to form a high-quality image on the sheet S.

If the first dimension Lc of the ink pressure chamber 14 is smaller than the first dimension Lc in this embodiment, on condition that a diameter Dm of the throttle hole 17 is sufficiently small or length Lm of the throttle hole 17 is sufficiently large, it is possible to efficiently eject the ink in the ink pressure chamber 14 to the sheet S from the nozzle 11 before the ink in the ink pressure chamber 14 escapes to the ink channel 15 from the throttle hole 17.

A dimensional relation among the nozzle 11, the ink pressure chamber 14, and the throttle hole 17 that can prevent the ink in the ink pressure chamber 14 from escaping to the ink channel 15 is explained with reference to Formulas (1) to (11) described below.

In Formulas (1) to (11), t represents time, E(t) represents a time function of a driving voltage generated between the first electrode 22 and the second electrode 23, P(t) represents a time function of the pressure of the ink that faces the vibrating plate 4 in the ink pressure chamber 14, Va(t) represents a time function of the volume displacement of the vibrating plate 4, A represents the volume displacement per unit voltage of the vibrating plate 4 deformed by a driving voltage, C represents the volume displacement per unit pressure of the vibrating plate 4 deformed by ink pressure in the ink pressure chamber 14, Sn represents an opening area of the nozzle 11, Un(t) represents a time function of the flow velocity of the ink that passes through the nozzle 11, Sc represents an opening area of the ink pressure chamber 14, Uc(t) represents a time function of the flow velocity of the ink pressurized in the ink pressure chamber 14, ρ represents the density of the ink, Ln represents the length of the nozzle 11, Lc represents the length (the first dimension) of the ink pressure chamber 14, Sm represents an opening area of the throttle hole 17, and Lm represents the length of the throttle hole 17.

When the diameter of the nozzle 11 is represented as Dn, the diameter of the ink pressure chamber 14 is represented as Dc, and the diameter of the throttle hole 17 is represented as Dm, Sn, Sc, and Sm are respectively calculated as $\pi(Dn/2)^2$, $\pi(Dc/2)^2$, and $\pi(Dm/2)^2$.

If the velocity of propagation of the pressure of the ink in the ink pressure chamber 14, i.e., the sound velocity of the ink is not taken into account, relations of Formulas (1) to (4) below hold.

Formula (1) indicates a relation between a deformation amount of the vibrating plate 4, which receives the ink pressure in the ink pressure chamber 14, and a driving voltage. Formula (2) indicates that a temporal change of the deformation amount of the vibrating plate 4 is equal to a sum of a flow rate of the ink in the nozzle 11 and a flow rate of the ink in the ink pressure chamber 14. Formula (3) indicates a flow velocity change of the ink in the nozzle 11 due to the ink pressure in the ink pressure chamber 14. Formula (4) indicates a flow velocity change of the ink in the ink pressure chamber 14 due to the ink pressure in the ink pressure chamber 14.

$$Va(t) = AE(t) - CP(t) \tag{1}$$

$$SnUn(t) + ScUc(t) = \frac{d}{dt}Va(t) \tag{2}$$

$$\frac{d}{dt}Un(t) = \frac{P(t)}{\rho \mathrm{Ln}} \tag{3}$$

$$\frac{d}{dt}Uc(t) = \frac{P(t)}{\rho(Lc + ScLm/Sm)} \tag{4}$$

Assuming that the time function E(t) of the driving voltage has a step waveform, i.e., E(t)=0 at t=0 and E(t)=1 at t>0, Formulas (1) to (4) are solved with respect to the flow velocity Un(t) of the ink in the nozzle 11. Then, Formula (5) is obtained.

$$Un(t) = \frac{A}{\rho \mathrm{Ln} C\omega}\sin\omega t \tag{5}$$

where, ω represents the angular velocity of the ink oscillating in the nozzle 11. The angular velocity ω can be indicated by formula (6).

$$\omega = \sqrt{\frac{Sn/\mathrm{Ln} + Sc/(Lc + ScLm/Sm)}{\rho C}} \tag{6}$$

Formula (5) indicates that the flow velocity of the ink in the nozzle 11 is higher as the angular velocity ω of the ink is lower. An oscillation frequency fc of the ink in the nozzle 11 is 2π/ω. The oscillation of the ink is oscillation caused by the deformation of the vibrating plate 4 caused by the ink pressure. The ink in the nozzle 11 is ejected using the oscillation.

If the driving voltage has a waveform other than the step waveform, the waveform is represented by superimposition of very small step waveforms. A result of Formula (5) is superimposed on the waveform. Consequently, if the waveform of the driving voltage is arbitrary, as in the case of the step waveform, the ink in the nozzle 11 oscillates at the angular velocity ω. The flow velocity of the ink in the nozzle 11 is larger as the angular velocity ω is smaller.

Formula (6) indicates that the angular velocity ω is small if Lc+Sc Lm/Sm is large, i.e., the length Lc of the ink pressure chamber 14 is large, the length Lm of the throttle hole 17 is large, or the opening area Sm of the throttle hole 17 is small. If Lc+Sc Lm/Sm is infinitely large, theoretically, the angular velocity ω is the smallest. Consequently, the flow velocity of the ink in the nozzle 11 due to the input of the driving voltage is maximized. The ink can be ejected with a minimum driving voltage.

In order to keep the driving voltage within a double of a theoretical minimum driving voltage, the angular velocity ω only has to be kept within a double of a theoretical minimum value. Therefore, an inequality (7) below is a condition for keeping the driving voltage within a double of the theoretically minimum driving voltage.

$$\sqrt[2]{\frac{Sn/\mathrm{Ln}}{\rho C}} \geq \sqrt{\frac{Sn/\mathrm{Ln} + Sc/(Lc + ScLm/Sm)}{\rho C}} \tag{7}$$

When Formula (7) is sorted out, Formula (8) is obtained.

$$\frac{Lc + ScLm/Sm}{Sc} \geq \frac{\mathrm{Ln}}{3\ Sn} \tag{8}$$

Consequently, it is possible to keep the driving voltage within a double of the theoretically minimum driving voltage by setting a relation among the length Ln of the nozzle 11, the length Lc of the ink pressure chamber 14, the length Lm of the throttle hole 17, the opening area Sn of the nozzle 11, the opening area Sc of the ink pressure chamber 14, and the opening area Sm of the throttle hole 17 as a relation of Formula (8).

In other words, when vibrating plate 4 bends in the direction for reducing the volume the ink pressure chamber 14 and pressurizes the ink, it is possible to eject the ink from the nozzle 11 before the ink in the ink pressure chamber 14 escapes in the direction of the ink channel 15.

If the throttle hole 17 is not provided and the ink channel 15 is directly opened in the ink pressure chamber 14, it is possible to apply Formula (8) by setting the length Lm of the throttle hole 17 to 0.

In the above explanation, it is assumed that the velocity of propagation of the ink pressure in the ink pressure chamber 14 (the sound velocity of the ink) is infinitely large. However, actual ink has finite sound velocity. Therefore, an oscillation phenomenon derived from the sound velocity of the ink occurs in the ink pressure chamber 14. If an oscillation frequency fs derived from the sound velocity of ink is lower than an oscillation frequency fc of the ink in the nozzle 11, the oscillation phenomenon derived from the sound velocity of the ink is predominant. As a result, the vibrating plate 4 is deformed and a pressure change occurs in the ink in the ink pressure chamber 14. Therefore, the ink in the ink pressure chamber 14 is ejected from the nozzle 11 and the original ink ejecting action is hindered.

To prevent this problem, the oscillation frequency fs derived from the sound velocity of the ink has to be higher than the oscillation frequency fc of the ink in the nozzle 11. The oscillation frequency fs can be calculated according to Formula (9).

$$fs = \frac{ss}{4\ Lc} \tag{9}$$

where, ss represents the sound velocity of the ink.

Therefore, a condition under which the oscillation frequency fc is higher than the oscillation frequency fs can be represented by Formula (10).

$$fc = \frac{\omega}{2\pi} = \frac{\sqrt{\frac{Sn/\mathrm{Ln} + Sc/(Lc + ScLm/Sm)}{\rho C}}}{2\pi} < \frac{ss}{4\ Lc} \tag{10}$$

The length Lc of the ink pressure chamber 14 needs to be larger than length specified by Formula (8) and smaller than length specified by Formula (10). Volume displacement C per unit pressure of the vibrating plate 4 deformed by the ink pressure in the ink pressure chamber 14 can be calculated according to Formula (11) by measuring a resonant frequency fa of the vibrating plate 4 in a state in which the ink is absent in the ink pressure chamber 14.

$$C = \frac{Sc^2}{(2\pi fa)^2 M} \tag{11}$$

where, M represents the mass of a movable section of the nozzle plate 2. The resonant frequency fa can be measured according to a well-known method by measuring electric impedance between the first electrode 22 and the second electrode 23.

In this embodiment, as shown in FIG. 4, the first substrate 12 is formed of a silicon substrate having thickness of 400 μm. The ink pressure chamber 14 having the diameter Dc of 190 μm is formed in the silicon substrate. The nozzle 11 opened in the center of the ink pressure chamber 14 has the length Ln of 6 μm and the diameter Dn of 20 μm. Further, the throttle hole 17 has the diameter Dm of 100 μm and the length Lm of 50 μm.

As a result, a value of the left side of Formula (8) is $2.05\times10^4$ [1/m] and a value of the right side of Formula (8) is $6.37\times10^3$ [1/m]. The relation of Formula (8) is satisfied. At the same time, the left side of the inequality of Formula (10) is 226 [kHz] and the right side of the inequality of Formula (10) is 844 [kHz]. Therefore, the ink can be ejected at a low driving voltage within a double of the theoretically lowest driving voltage. In addition, the ink ejecting action is not hindered by the oscillation phenomenon derived from the sound velocity of the ink and a normal ink ejecting action can be performed.

The sound velocity ss of the ink is set to 1350 [m/s] and the volume displacement per unit pressure of the vibrating plate 4 deformed by the ink pressure is set to $5\times10^{-20}$ [m3/Pa].

On the other hand, in the first inkjet head 1A according to this embodiment, the actuator 20 that displaces the vibrating plate 4 is integrally incorporated in the nozzle plate 2. If the driving voltage from the first electrode 22 and the second electrode 23 is applied to the piezoelectric layer 21 of the actuator 20, an electric current flows to the piezoelectric layer 21 and electric energy is generated. This energy is referred to as consumed energy of the actuator 20.

The inventor involved in the development of the first inkjet head 1A found that thickness of the nozzle plate 2 and the diameter (the second dimension Dc) of the ink pressure chamber 14 substantially affect the consumed energy of the actuator 20 in displacing the vibrating plate 4.

In other words, in order to efficiently ejecting the ink from the nozzle 11, it is necessary to displace the vibrating plate 4 to pressurize the ink filled in the ink pressure chamber 14 to desired pressure to enable the ink to be ejected from the nozzle 11. Therefore, the actuator 20 that displaces the vibrating plate 4 has to drive the vibrating plate 4 to ensure that the pressure applied from the vibrating plate 4 to the ink in the ink pressure chamber 14 is appropriate.

In this case, if the diameter of the ink pressure chamber 14 is determined without taking into account the thickness of the nozzle plate 2, it is likely that a relation between the length of the nozzle 11 and the diameter of the ink pressure chamber 14 becomes inappropriate and the consumed energy of the actuator 20 increases. If the consumed energy increases, the vibrating plate 4 cannot be efficiently driven.

Therefore, the inventor verified the consumed energy of the actuator 20 at the time when the diameter of the ink pressure chamber 14 was changed in an inkjet head in which the thickness dimension of the nozzle plate 2 was 10 μm.

Figure 6:
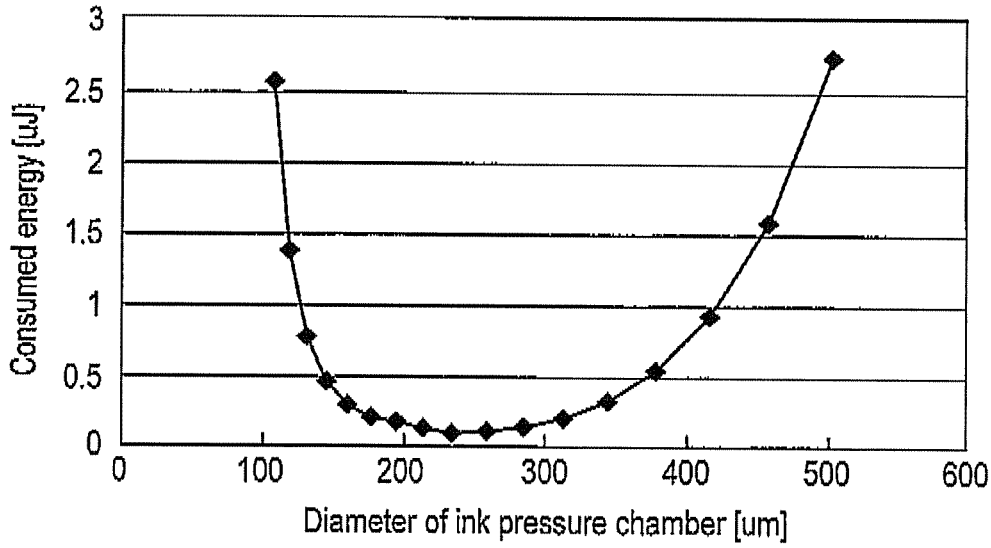
FIG. 6 is an exemplary characteristic chart for explaining a relation between the diameter of an ink pressure chamber and consumed energy of an actuator.

FIG. 6 is a characteristic chart for explaining a relation between the diameter of the ink pressure chamber 14 and the consumed energy of the actuator 20. As it is evident from FIG. 6, it is recognized that, when the diameter of the ink pressure chamber 14 is 100 μm and 500 μm, the consumed energy of the actuator 20 tends to sharply rise to exceed 2.5 [uJ].

On the other hand, when the diameter of the ink pressure chamber 14 is in a range of 200 μm to 300 μm, the consumed energy of the actuator 20 is 0.1 [uJ] to 0.2 [uJ] and the consumed energy is suppressed to be substantially low.

Therefore, for example, in the inkjet head in which the thickness dimension of the nozzle plate 2 is 10 μm, it is possible to reduce the consumed energy of the actuator 20 by setting the diameter of the ink pressure chamber 14 to be 200 μm to 300 μm. Consequently, it is possible to efficiently drive the vibrating plate 4 with the actuator 20 and keep the pressure applied to the ink appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. The inkjet head comprising:

a substrate in which an ink pressure chamber filled with ink is formed;

a nozzle plate laminated on the substrate, the nozzle plate including a nozzle opened in the ink pressure chamber and a vibrating plate exposed to the ink pressure chamber; and an actuator incorporated in the nozzle plate, the actuator displacing the vibrating plate in a thickness direction to pressurize the ink in the ink pressure chamber via the vibrating plate and eject the ink from the nozzle, wherein when length of the nozzle in a thickness direction of the nozzle plate is represented as Ln, an opening area of the nozzle in an extending direction of the nozzle plate is represented as Sn, length of the ink pressure chamber in the thickness direction of the nozzle plate is represented as Lc, and an opening area of the ink pressure chamber in the extending direction of the nozzle plate is represented as Sc, a relation Lc/Sc>=Ln/Sn/3 is satisfied.

2. The inkjet head of claim 1, further comprising:

an ink channel provided on an opposite side of the nozzle with respect to the ink pressure chamber; and a throttle hole configured to cause the ink channel and the ink pressure chamber to communicate with each other, wherein when an opening area of the throttle hole is represented as Sm and length of the throttle hole is represented as Lm, a relation (Lc+Sc Lm/Sm)/Sc>=Ln/Sn/3 is satisfied.

3. An inkjet recording apparatus comprising:

a conveying path for conveying a recording medium; and an inkjet head configured to eject ink to the recording medium to form an image on the recording medium, the inkjet head including:

a substrate:

an ink pressure chamber provided in the substrate and filled with the ink, the ink pressure chamber having a first dimension in a thickness direction of the substrate and a second dimension in a direction orthogonal to the thickness direction of the substrate, the first dimension being larger than the second dimension;

a nozzle plate laminated on the substrate, the nozzle plate including a nozzle provided to communicate with the ink pressure chamber and a vibrating plate exposed in the ink pressure chamber; and an actuator incorporated in the nozzle plate, the actuator displacing the vibrating plate in the thickness direction to pressurize the ink in the ink pressure chamber via the vibrating plate and eject the ink from the nozzle;

wherein, when length of the nozzle in a thickness direction of the nozzle plate is represented as Ln, an opening area of the nozzle in an extending direction of the nozzle plate is represented as Sn, length of the ink pressure chamber in the thickness direction of the nozzle plate is represented as Lc, and an opening area of the ink pressure chamber in the extending direction of the nozzle plate is represented as Sc, a relation Lc/Sc>=Ln/Sn/3 is satisfied.

4. The apparatus of claim , further comprising;

an ink channel provided on an opposite side of the nozzle with respect to the ink pressure chamber; and a throttle hole configured to cause the ink channel and the ink pressure chamber to communicate with each other, wherein when an opening area of the throttle hole is represented as Sm and length of the throttle hole is represented as Lm, a relation (Lc+Sc Lm/Sm) /Sc>=Ln/Sn/3 is satisfied.

5. The apparatus of claim 3, wherein, when the opening area of the nozzle is represented as Sn, the opening area of the ink pressure chamber is represented as Sc, volume displacement per unit pressure of the vibrating plate deformed by ink pressure in the ink pressure chamber is represented as C, sound velocity of the ink is represented as ss, and density of the ink is represented as p, a relation $$\frac{\sqrt{\frac{Sn/\mathrm{Ln} + Sc/Lc}{\rho C}}}{2\pi} < \frac{ss}{4\ Lc}$$

is satisfied.

6. The apparatus of claim 4 wherein, when the opening area of the throttle hole is represented as Sm and the length of the throttle hole is represented as Lm, a relation $$\frac{\sqrt{\frac{Sn/\mathrm{Ln} + Sc/(Lc + ScLm/Sm)}{\rho C}}}{2\pi} < \frac{ss}{4\ Lc}$$

is satisfied.

* * * * *